US007496982B2

(12) United States Patent
Clark et al.

(10) Patent No.: US 7,496,982 B2
(45) Date of Patent: Mar. 3, 2009

(54) FOOTWEAR

(76) Inventors: Galahad Clark, 1 Leverton Place, London NW5 2PL (GB); Rement Koolhaas, Amsteldijk 77-B, NL-1074 JA Amsterdam (NL)

( * ) Notice: Subject to any disclaimer, the term of this patent is extended or adjusted under 35 U.S.C. 154(b) by 502 days.

(21) Appl. No.: 10/494,124

(22) PCT Filed: Nov. 4, 2002

(86) PCT No.: PCT/GB02/05030

§ 371 (c)(1),
(2), (4) Date: Nov. 22, 2004

(87) PCT Pub. No.: WO03/037123

PCT Pub. Date: May 8, 2003

(65) Prior Publication Data

US 2005/0076537 A1 Apr. 14, 2005

(30) Foreign Application Priority Data

Nov. 2, 2001 (GB) ..... 0126323.5

(51) Int. Cl.
*A43D 11/00* (2006.01)
*A43B 3/12* (2006.01)

(52) U.S. Cl. ..... 12/142 G; 12/142 J; 12/142 S; 36/11.5; 36/9 R

(58) Field of Classification Search ..... 363/11.5, 363/9 R, 9 A, 34 R; 36/24.5, 11.5, 9 R, 9 A, 36/34 R; 12/142 G, 142 J, 142 S
See application file for complete search history.

(56) References Cited

U.S. PATENT DOCUMENTS

| | | | | |
|---|---|---|---|---|
| 2,208,104 | A * | 7/1940 | Perugia | 36/92 |
| 2,486,886 | A * | 11/1949 | Saukkonen | 36/11.5 |
| 2,611,677 | A | 9/1952 | Yamada | |
| 2,831,272 | A * | 4/1958 | Sloat | 36/170 |
| 3,217,429 | A | 11/1965 | Sabo | |
| 3,251,144 | A * | 5/1966 | Weitzner | 36/87 |
| 4,145,822 | A * | 3/1979 | Mitchell et al. | 36/87 |
| 4,766,680 | A * | 8/1988 | Maciel et al. | 36/87 |
| 4,811,499 | A * | 3/1989 | Jensen | 36/10 |
| 5,265,349 | A * | 11/1993 | Munschy | 36/97 |
| 6,226,893 | B1 * | 5/2001 | Schlamp et al. | 36/11.5 |
| 2003/0029056 | A1 * | 2/2003 | Frederiksen et al. | 36/11.5 |
| 2004/0000070 | A1 * | 1/2004 | Wright et al. | 36/11.5 |
| 2004/0025372 | A1 * | 2/2004 | Watanabe | 36/8.1 |
| 2004/0055179 | A1 * | 3/2004 | Wang | 36/11.5 |

FOREIGN PATENT DOCUMENTS

| | | |
|---|---|---|
| CH | 497146 | 10/1970 |
| FR | 1266650 | 7/1961 |
| FR | 2726975 | 5/1996 |
| GB | 647998 | 12/1950 |
| GB | 1594127 | 7/1981 |
| WO | WO 01/49141 | 7/2001 |

* cited by examiner

*Primary Examiner*—Marie Patterson
(74) *Attorney, Agent, or Firm*—Ballard Spahr Andrews & Ingersoll, LLP

(57) ABSTRACT

A shoe formed from a shoe blank having first and second surfaces, wherein one end of the shoe blank is twisted with respect to the opposite end and the first surface of each end is connected together in face contacting arrangement so as to provide a shoe with a one-sided continuous surface.

20 Claims, 7 Drawing Sheets

FOOTWEAR

CROSS REFERENCE TO RELATED APPLICATIONS

The present application claims priority to Great Britain Application No. 0126323.5, filed Nov. 2, 2001, which application is incorporated herein fully by this reference.

The present invention relates to footwear; more particularly, it relates to a type of shoe that is simple and cost-effective in terms of production, but which retains both comfort and aesthetic appeal.

Currently, shoes that are available tend to comprise a series of distinct, interconnected components. Even the very simplest of shoes includes a foot-bed, shoe upper components, a sole and a heel, attached by some securing means such as gluing and/or stitching.

A shoe concept comprising a series of interconnected components is disclosed in PCT Patent WO 01/49141. Indeed, the assembly disclosed in that patent's specification comprises a plurality of components, even though they relate to an assembly for only the upper section of a shoe. In terms of materials, and also of construction, this option is evidently a more complicated one than the integral concept of the present invention.

It is an object of the present invention to solve, or at least to mitigate, the problems and complications associated with the prior art in this field.

According to a first aspect of the invention, here is provided a shoe formed from a shoe blank having first and second surfaces, wherein one end of the shoe blank is twisted with respect to the opposite end and the first surface of each end is connected together in face contacting arrangement so as to provide a shoe with a one-sided continuous surface.

Preferably the shoe blank is applied to a shoe former to maintain the shoe in a set up condition. Optionally, the shoe blank is an integral one-piece construction.

According to a second aspect of the invention there is provided a shoe formed from a plurality of distinct interconnected components, to provide a heel, a foot bed section and a front section, each component having first and second surfaces, arranged to provide a shoe with a one sided continuous surface.

Preferably the distinct components are a heel part, a foot part comprising the instep and nose portions, and one or more sole components.

According to an optional feature of this aspect of the invention, the heel region comprises an open loop. Preferably, the heel region comprises a solid support within the loop. More preferably, the solid support is so constructed and arranged as to fill the cavity of the heel loop.

According to a third aspect of the invention there is provided a shoe comprising a heel section, a foot bed section and a front strap for retaining a user's foot, wherein the heel section is an open loop. In one class of embodiments, the open loop is adapted to flex in a resilient manner to absorb a degree of impact during use.

According to an optional feature of this aspect of the invention, the heel region further comprises a solid support within said loop.

Preferably, the solid support is so constructed and arranged as to fill the cavity of the said heel loop. More preferably, the solid support is manufactured from a flexible plastics material or foam.

According to an optional feature of any preceding aspect of the invention, the shoe is formed from a shoe blank constructed of a plastics material; leather; rubber; or any combination of the aforesaid materials. Optionally, the plastics material is fibre-reinforced plastics material; a polyurethane; a combination of polyurethanes; foam; or any combination of the aforesaid materials.

According to an optional feature of any preceding aspect of the invention there further comprises a steel shank to improve rigidity of the shoe.

The shoe and/or former, as the case may be, is a solid polyurethane unit. Alternatively, the shoe and/or former is formed from Kevlar or carbon-fibre.

According to a fourth aspect of the invention there is provided a method of forming a shoe from a shoe blank comprising a plurality of components including a heel part, a front portion and a sole, wherein the heel part and the front part are first connected to one another and fixed by securing means, this combination of these two components subsequently having finishing means applied thereto, before the addition of the sole, which sole is fixed to the finished combination of the heel part and the front part by securing means.

Preferably the finishing means comprises a leather coverage.

According to an optional feature of this aspect of the invention, the finishing means comprises a flexible coating of plastics material, and a layer of leather, which layer of leather is applied to each of those parts of the resultant shoes which is to come into contact with the user's foot.

According to a fifth aspect of the invention there is provided a method for forming a shoe from a one piece shoe blank having first and second surfaces comprising the steps of (i) twisting a first end of the shoe blank;

(ii) folding the first end under a middle part of the blank to form a heel;

(iii) folding said first end over the opposed end and into abutment with the opposed end to form a foot bed section;

(iv) securing the first surface of said opposed ends in face contacting arrangement to form a shoe with a one-sided continuous face.

According to a sixth aspect of the invention there is provided a shoe to accommodate a foot, formed from a shoe blank folded into a three-dimensional shape by twisting one end of the said shoe blank through an angle of 180° and attaching said end to the opposite end of the blank in such a way that the resultant three-dimensional shape has only one continuous face.

Exemplary embodiments of the present invention will hereinafter be described, with reference to the accompanying drawings, in which:

FIG. 12 is a cross section of a central section of the shoe formed from the parts shown in FIG. 13; and.

Figure 1:
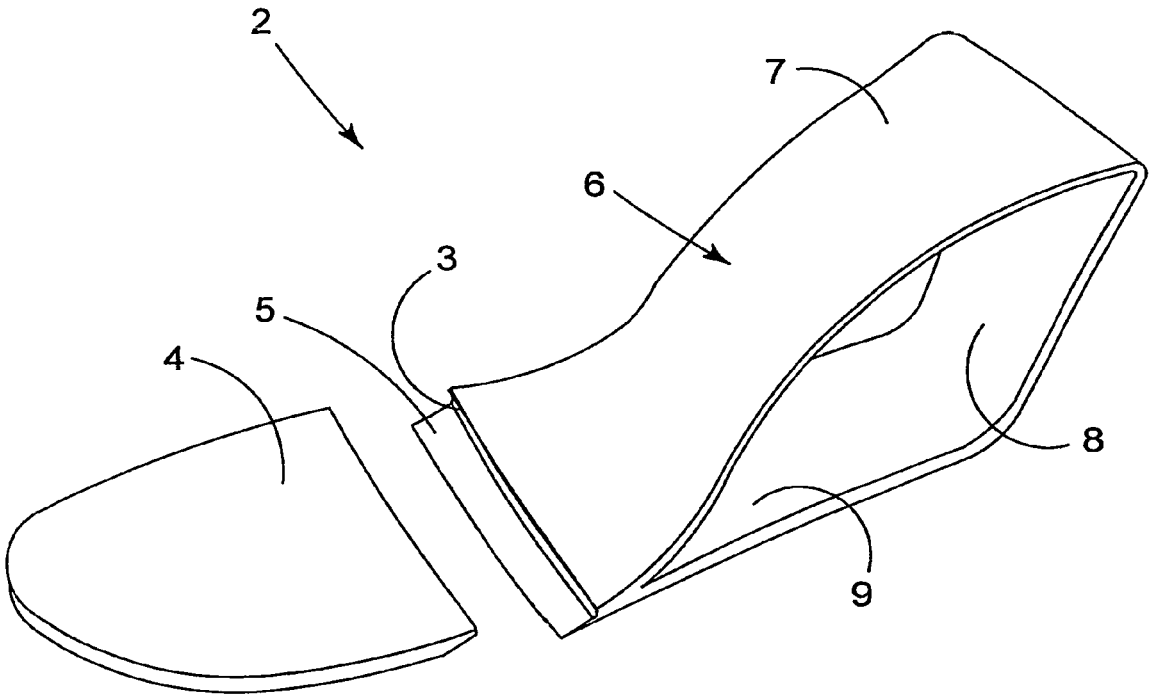
FIG. 1 is an exploded view of a shoe former 2 used with a shoe blank 10 to form a shoe according to a preferred embodiment of the present invention.
Figure 2:
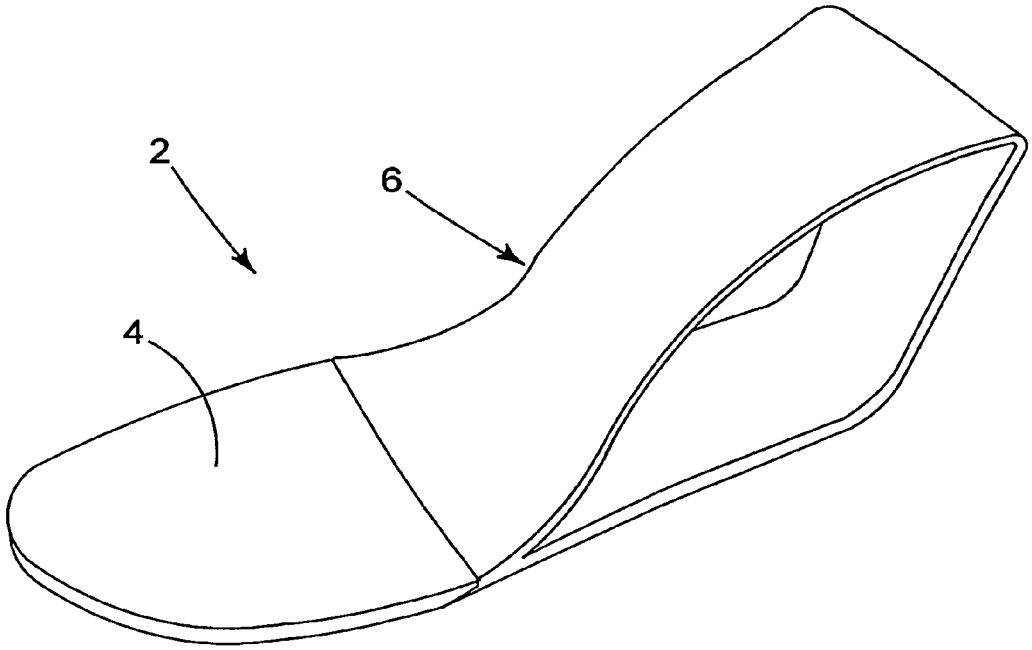
FIG. 2 is a perspective view of the shoe former as shown in FIG. 1.

In FIGS. 1 and 2 there is shown a shoe former 2, used in conjunction with a shoe blank 10, to form a shoe 20. The shoe former can be supplied as a single unit similar to that shown in FIG. 2, or a multi-part unit, as illustrated in FIG. 1. In FIG. 1, the shoe former 2 is formed as a two-part unit with a front part 4 and a rear part 6. The rear part 6 has a foot bed section 7, a heel 8 and a base 9, which are connected to form a loop. The front and rear parts 4 and 6 are secured together by suitable securing means, for example glue or mechanical fixings along overlapping surface(s) 3, 5 so as to construct the shoe former shown in FIG. 2.

The shoe former 2 is, in this embodiment, made from suitable plastics material, for example nylon resin or polyurethane. Alternatively, it can be manufactured from one or more materials outlined below.

Preferably, the rear part 6 and more preferably, the heel section 8 of the loop is adapted to flex in a resilient manner thereby to allow absorption of the impact with the ground, during use, thereby to improve comfort. Additionally, or alternatively, the foot bed section 7 is constructed to flex between its ends in like manner.

Figure 3:
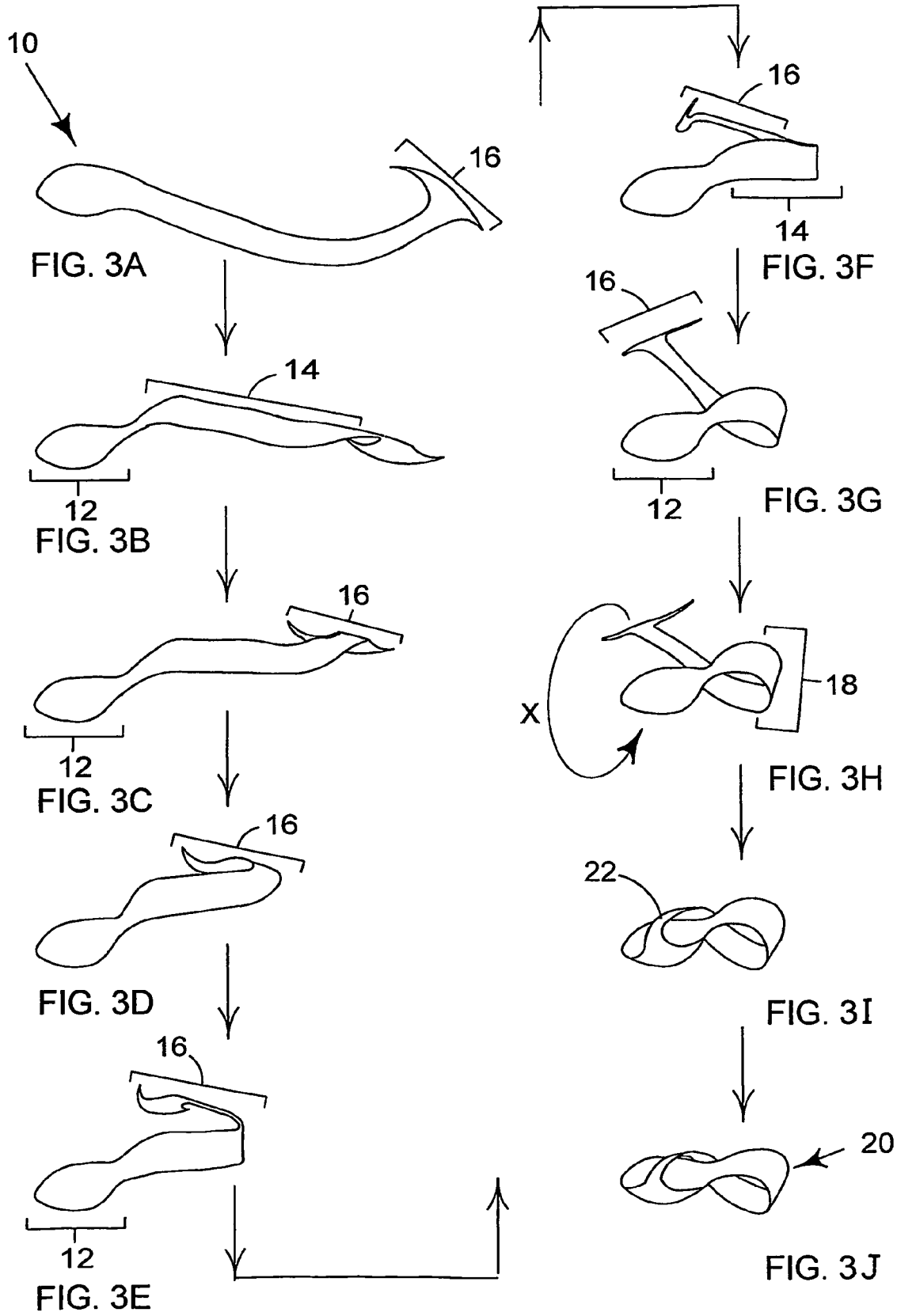
FIGS. 3A to 3J show how a shoe according to one embodiment of the present invention may be folded and constructed from a one-piece integral shoe-blank 10.
Figure 4:
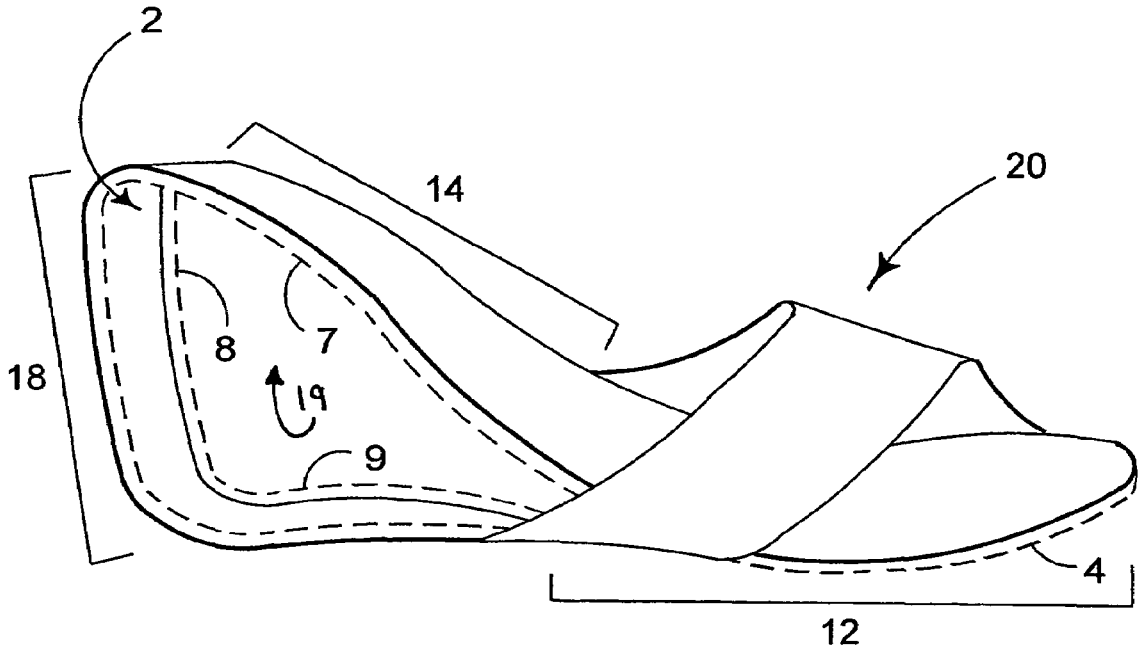
FIG. 4 and FIG. 5 are respectively a side view of the outside face of a shoe, and a rear perspective three-quarter view of a shoe 20, both according to the first embodiment of the present invention.

Turning to the construction of the shoe blank, according to a preferred embodiment of the present invention, a shoe blank 10 (FIG. 3) preferably comprises a front section 12, a foot-bed portion 14 and a securing portion 16. Each one of these sectors of the shoe blank 10 is clearly shown by FIGS. 3 and 4 viewed in combination; FIG. 3 shows the different sectors of the blank 10 more clearly whilst FIG. 4 shows each of these parts in the assembled shoe 20.

The configuration of the shoe blank 10 comprising these components is illustrated in FIG. 3. The front section 12 is connected to the foot-bed portion 14, which is in turn connected to the securing portion 16. It will be recognised that these 'connections' need not be specifically connections of a foldable, hinged or frangible nature. Indeed, according to this preferred embodiment of the present invention, they are not connections between distinct or separate components at all. In this embodiment, the shoe blank 10 is an integral unit comprising these three different component sections 12, 14, 16.

One method of construction of a shoe 20 from the one-piece shoe blank 10 shall now be described with reference to FIGS. 3A to 3J; of course, other methods are envisaged without departing from the scope of invention.

The front section 12 is first folded into a position lower than, but substantially parallel to, the rest of the shoe blank 10. This stage of the process is shown in FIGS. 3A and 3B.

Figure 6:
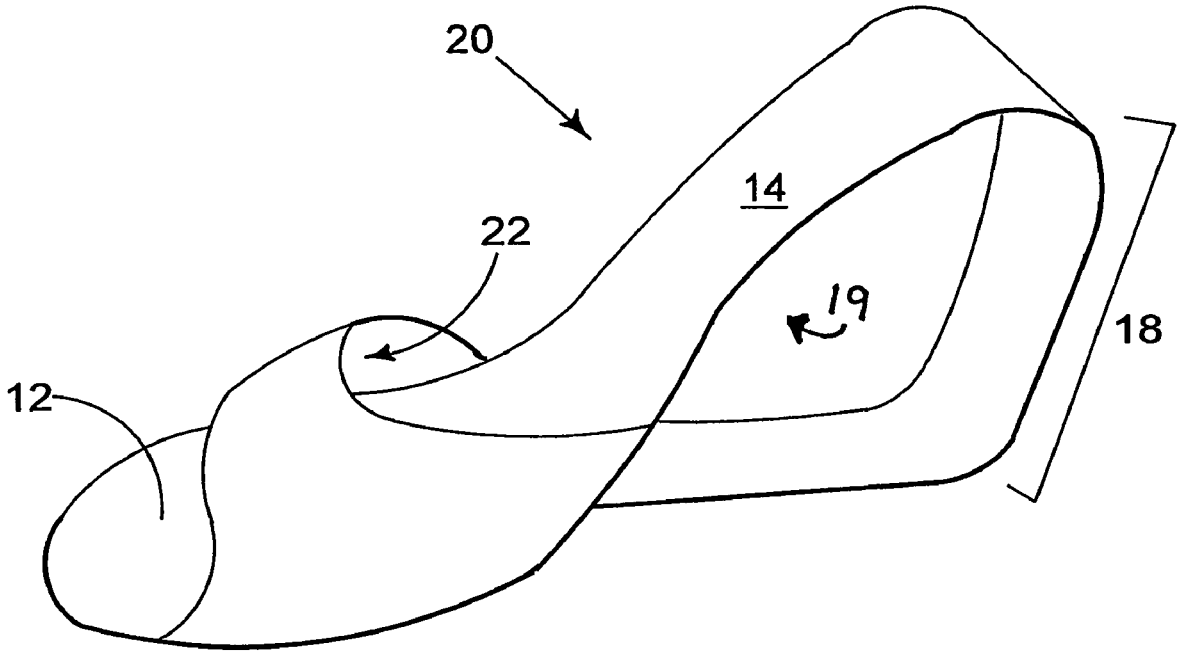
FIG. 6 and FIG. 7 are respectively a perspective view and a plan view of the shoe shown in FIG. 4.

Subsequently, the securing portion 16 and the rear section of the foot-bed portion 14 are folded under the shoe blank 10 in such a way as to form a looped heel section 18. This folding arrangement is illustrated in FIGS. 3C to 3H, FIG. 3H being the first to show the assembled looped heel section 18. The securing portion 16 is then folded in the direction X, in order that it may be brought into abutment with one side of the front section 12, as is shown in FIG. 3I. The securing portion 16 and the remainder of the foot-bed portion 14 are brought over the front section 12 in such a way as to form an instep loop 22 to accommodate the front part of the user's foot. This instep loop 22 is most clearly shown in FIG. 6, and in FIGS. 3I and 3J. In some embodiments, the loop 22 extends forward to cover the front of the shoe, thereby to provide an enclosed portion.

Figure 7:
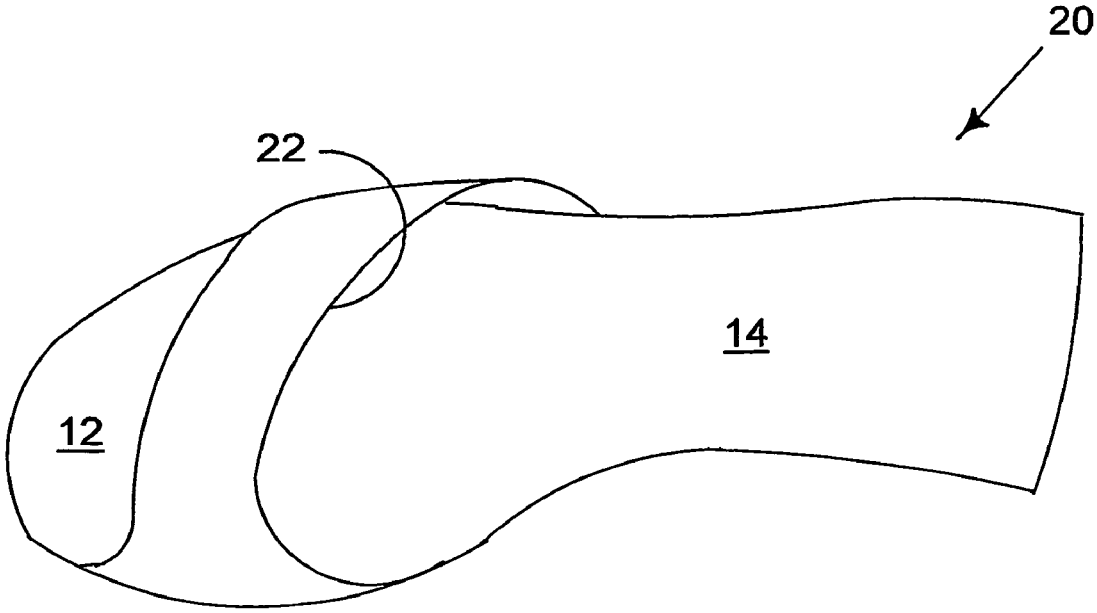
Figure 8:
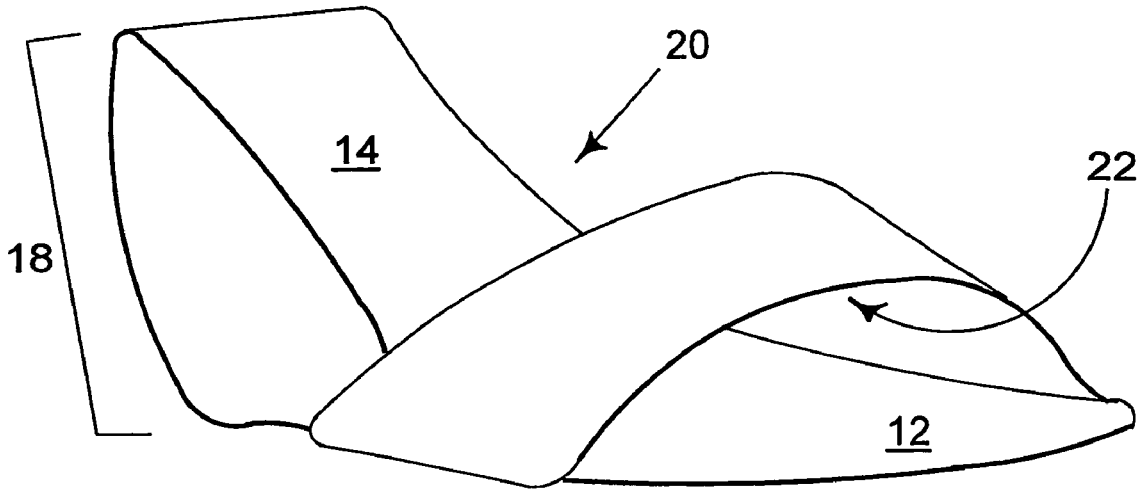
FIG. 8 is a perspective view from the front of the shoe shown in FIG. 4.

It is during this last stage of the process that the twist takes place to form a strip, which gives a three-dimensional shape that has a single, continuous face (or surface). This shape is most clearly represented in FIGS. 3J, 7 and 9. Further to the technical advantages of such a configuration, the appearance of this shape is a distinctive and important aesthetic aspect of the present invention.

Figure 9:
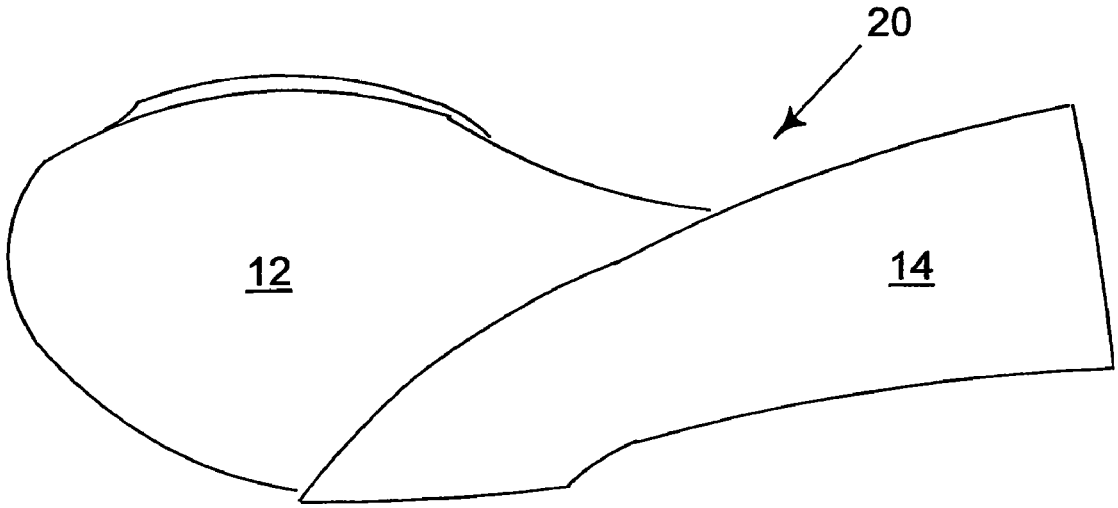
FIG. 9 is a plan view of such the shoe, viewed from below and showing the sole region of the shoe of FIG. 4.

The application of securing means, for example adhesive or other mechanical fixing, to secure the securing portion 16 to the underside of the front section 12, completes the construction of the shoe 20 from the shoe blank 10, as according to a preferred embodiment of the present invention. The appearance of the underside or sole portion of the resulting shoe 20 is illustrated in FIG. 9.

The formation of the continuous face shown in FIG. 3 is carried out by moulds and conventional equipment so that it can be constructed by hand or automated machinery.

Figure 5:
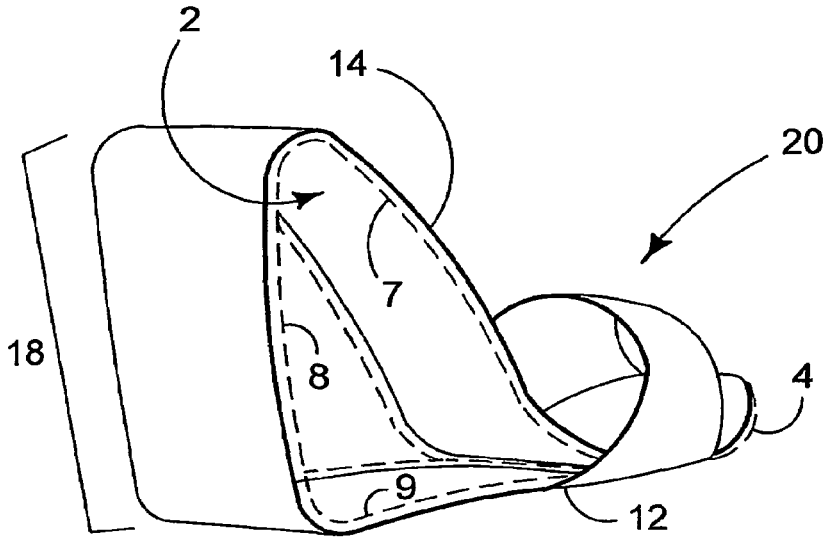

In one class of embodiments, as shown in FIGS. 4 and 5, the shoe former 2 is used in conjunction with the blank 10 to facilitate construction of the shoe. The forming process is identical or substantially similar to that outlined above with reference to FIG. 3, but the formation of the loop 18 is assisted by wrapping the rear section of the foot bed portion 14 around the heel and base 8, 9 of the shoe former 2. In one class of embodiments, the foot bed portion 14 is secured to one or more faces of sections 7, 8 and/or 9 of the shoe former. In some embodiments, the front portion 12 is secured to the front section 4 of the former.

To complete construction of the shoe, the securing portion 16 is secured to the front portion 12 of the blank, which in turn is secured to the front section 4. Alternatively, the securing portion 16 is secured to the underside of the former 2 to form a multi-ply structure, with the front section 4 of the former 2 intermediate the opposite ends 12, 16 of the blank 10, and secured thereto.

The aforementioned embodiment of shoe 20 is also illustrated in FIGS. 6, 7, 8 and 9 in which the front portion 12, the foot bed portion 14, the heel portion 18 and instep loop 22 are illustrated.

One advantage of the present invention is that it provides a further benefit to the manufacturer and/or designer in its versatility. It is versatile in that it may further be varied to produce shoes 20 of varying heights, styles and configurations. Indeed, to produce a different shoe 20 all that needs to be changed is the shape or length of the original shoe-blank 10 and/or former 2 from which the shoe 20 may be formed.

A further advantage to the integral one-piece assembly is in its durability. By reducing the number of the joins between separate components that characterise the prior art in this field, the potential for breakages at such joins is reduced.

Figure 10:
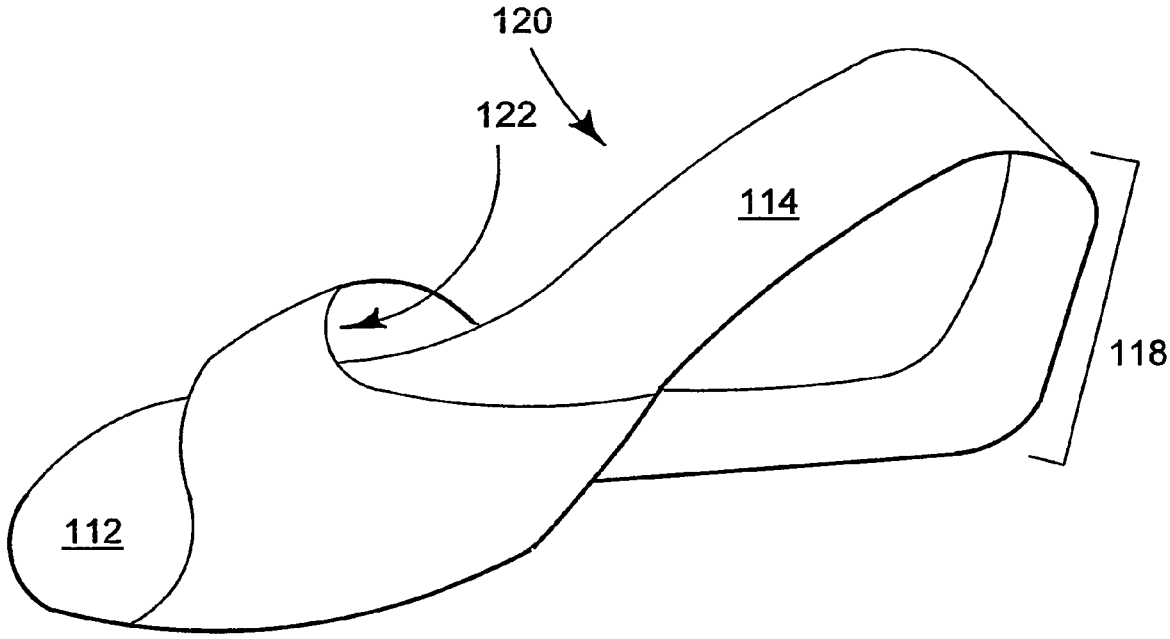
FIG. 10 and FIG. 11 are perspective views of alternative embodiments of the present invention.
Figure 11:
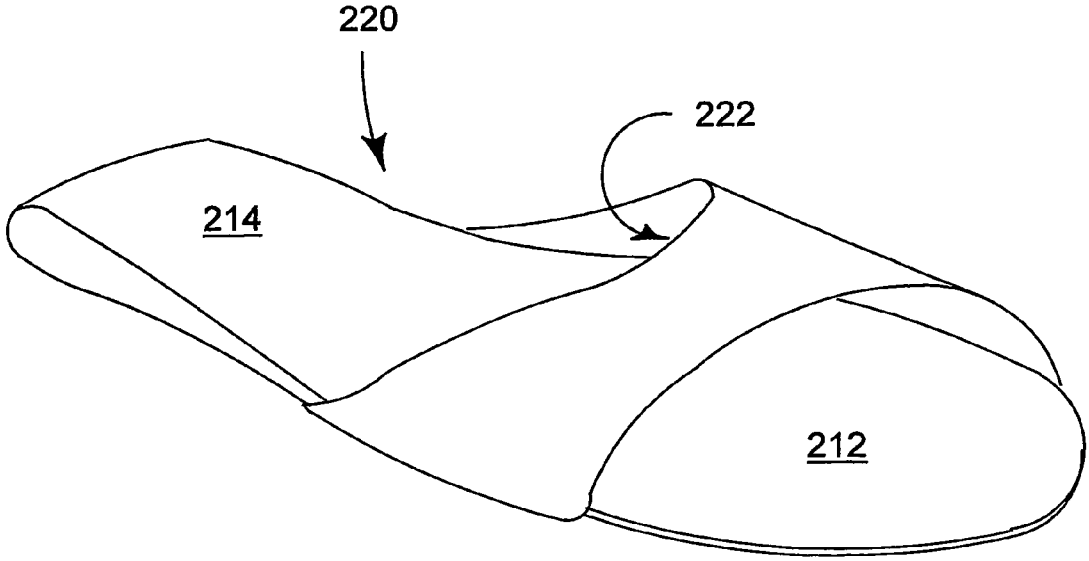

It is envisaged that further embodiments of the present invention, including heel sections 118, 218, of different heights, may be constructed by a similar method. These second and third embodiments of the shoe 120, 220, both retain the same reference numerals as the preferred embodiment hereinbefore described, but each numeral is preceded by a prefix number of '1' for the second embodiment, '2' for the third, and are illustrated in FIGS. 10 and 11 respectively.

In each of the aforementioned embodiments, there is shown a shoe comprising a heel section, a foot bed section and a front strap for retaining a user's foot. The heel section is an open loop 19 (FIGS. 4 and 6), which, in some embodiments, can be adapted to flex in a resilient manner to thereby to absorb a degree of impact during use.

Optionally, the loop is provided with an internal support, which fills, at least in part the cavity between the base and foot bed portion 14. The support is manufactured from suitable plastics material and can be fitted after the shoe has been formed or is formed integrally with the shoe former 2. In those embodiments with a loop that flexes, the support is provided by a flexible plastics material or a foam based composition.

Figure 12:
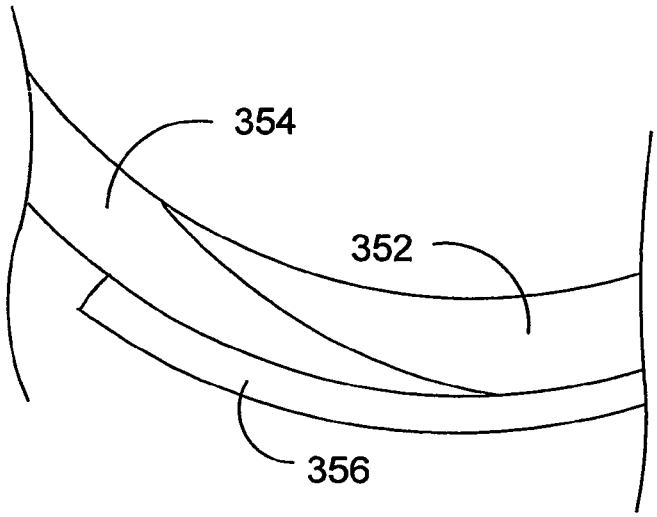
Figure 13:
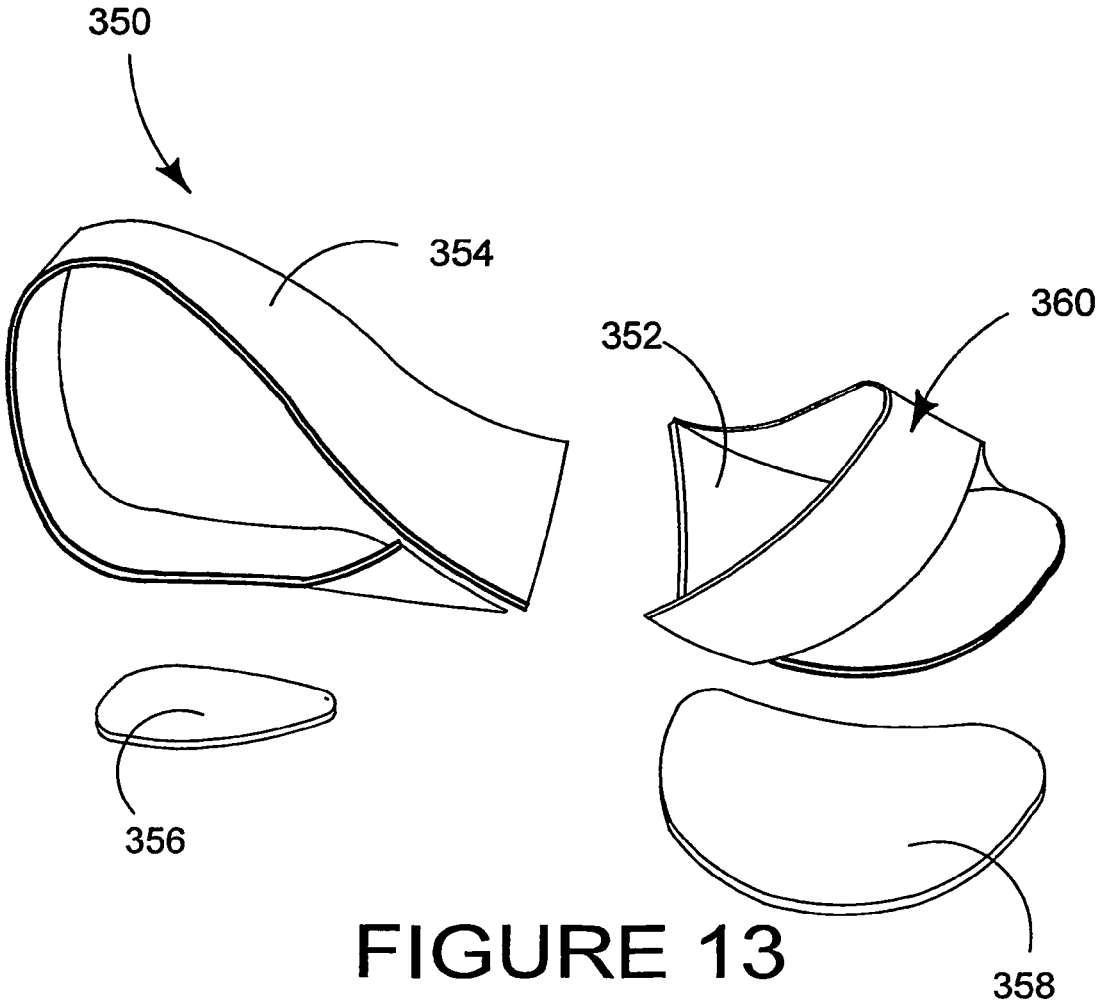
FIG. 13 is an exploded view of a fourth embodiment of the present invention, wherein a shoe is formed from four parts.

Alternative methods of construction are envisaged, for example in a fourth embodiment of the present invention, represented in FIGS. 12 and 13 of the accompanying drawings, a shoe may be constructed from a plurality of components.

Preferably, there are four individual interconnected components are employed which means that, the relative simplicity of construction is retained and the advantages hereinbefore described still apply.

A degree of durability is retained by the shoe 350, due to the use of a small number of components. The versatility of the design is equal or greater; a modification needs only to be made to one component of the shoe 350 to produce a shoe 350 with a different configuration.

In this fourth embodiment of FIG. 12, a shoe 350 preferably comprises a heel part 354, an instep-and-nose part 352, a first sole component 356 and a second sole component 358. The way in which the shoe 350 is configured by the connection of these four individual components is shown in FIG. 13 of the accompanying drawings.

Optionally, the heel part 354 is constructed of injection-moulded hard fibre reinforced plastics material. Preferably, the instep-and-nose part 352 is constructed either of soft polyurethane, or of a combination of leather and foam. The first sole component 356 and the second sole component 358 are preferably constructed of rubber or of leather.

In one class of preferred embodiment the shoe is moulded from a solid polyurethane unit with a steel shank in the mould to keep the heel loop solid and to improve rigidity of the shoe.

In carrying out the manufacture of the shoe 350 as according to this fourth embodiment of the present invention, the heel part 354 is first connected by securing means, for example adhesive, to the instep-and-nose part 352. Before adding either the first sole component 356 or the second sole component 358, the combination of the heel part 354 and the instep-and-nose part 352 is finished with a suitable layer for example a fully leather coverage or a flexible coating of plastics material. If the flexible coating of plastics material is applied, then a leather slab will need to be applied to both the foot bed and the inside surface of the instep band-loop 360.

To complete the formation of a shoe 350, the first sole component 356 and the second sole component 358 are added to the part assembled shoe and secured by suitable securing means, such as adhesive, to the finished combination of the heel part 354 and the instep-and-nose part 352. In assembling such a shoe, the components 352, 354 and 356 are interconnected in such a way as shown in FIG. 12. Thus a shoe is formed which has an appearance substantially the same as a shoe constructed as according to any preceding embodiment of the present invention, as described hereinbefore.

It is further envisaged that the shoe, shoe blank and/or shoe former, formed as according to any one of the embodiments hereinbefore described, may be constructed from leather; rubber; plastics material such as fibre-reinforced plastics material; a polyurethane or combination of polyurethanes; foam; or any combination of these materials. Other suitable materials for the shoe and/or shoe former include Kevlar, nylon, carbon-fibre, wood or a suitably rigid metal.

It will be understood that terms of orientation or function used to identify different components of the present invention such as "front", "rear", "foot-bed portion" and the like, do not limit their relevant components to these orientations or functions. Indeed, they serve simply to identify such components from one another. It is envisaged that the invention can be applied to a variety of footwear and is not limited to those of the type hereinabove described. Further or alternatively, the footwear may be adapted without departing from the scope of the invention.

The invention claimed is:

1. A method for forming a shoe from a one-piece shoe blank having first and second opposed ends with a series of portions between the first and second ends, said series of portions comprising in order from the first end a forepart portion, a foot bed portion, a heel shaft portion, a heel sole portion, an upper portion and a securing portion, said method comprising the steps of:

(a) effecting transverse folds in the blank thereby to delineate said forepart portion, foot bed portion, heel shaft portion, heel sole portion and upper portion;

(b) arranging the folded blank so that the foot bed portion rises from the forepart portion, the heel shaft portion extends generally perpendicularly to and spaced from the forepart portion and the heel sole portion extends forwardly from the heel shaft portion so as to partially underlie part of the forepart portion;

(c) twisting the upper portion round with respect to the heel sole portion so as to overlie with clearance the forepart portion to form a shoe upper for retaining a wearer's foot; and (d) securing said securing portion to said forepart portion so as to form a shoe having an open loop heel section comprising a foot bed, heel shaft and heel sole defined by the corresponding portions of the blank and having a forepart section defined by the forepart and upper portions of the blank.

2. A method as claimed in claim 1, further comprising arranging the folded blank so that said securing portion underlies said forepart portion and then securing said securing portion to said forepart portion.

3. A method as claimed in claim 1, and further comprising forming the foot bed portion, heel shaft portion and heel sole portion around a heel former defining a required shape and form for said open loop heel section, to facilitate the construction of the heel section.

4. A method as claimed in claim 3, wherein said shoe former comprises a solid support constructed and arranged for filling the cavity of the open loop heel section.

5. A method as claimed in claim 1, and further comprising arranging the folded blank so that a part of the heel sole portion underlies a part of the forepart portion; and attaching said part of the securing portion to said part of the forepart portion.

6. A method as claimed in claim 2, wherein said twisting of the upper portion over said forepart portion also brings a part of the upper portion beneath the foot bed portion; whereafter said part of the upper portion is attached to said foot bed portion.

7. A method as claimed in claim 5, and including disposing a forepart former between the forepart portion and the securing portion, said forepart former having a shape generally corresponding to the shape of the forepart portion.

8. A method as claimed in claim 7, and further comprising forming the foot bed portion, heel shaft portion and heel sole portion around a heel former defining a required shape and form for said open loop heel section, said heel former being integrally formed with said forepart former.

9. A method as claimed in claim 1, and further comprising applying a finish to exposed surfaces of the blank.

10. A method as claimed in claim 9, and including attaching a shoe sole beneath the open loop heel section and forepart section of said shoe.

11. A shoe formed from a one-piece shoe blank having first and second opposed ends with a series of portions between the first and second ends, said series of portions comprising in order from the first end a forepart portion, a foot bed portion, a heel shaft portion, a heel sole portion, an upper portion and a securing portion, wherein said shoe is formed by the method as claimed in claim 1 so as to form a shoe having an open loop heel section comprising a foot bed, heel shaft and heel sole and a forepart section having a forepart and upper portion.

12. A shoe as claimed in claim 11, wherein said shoe includes a heel former, said heel former being disposed within the heel section and defining a required shape and form for said open loop heel section.

13. A shoe as claimed in claim 12, wherein said heel former comprises a solid support constructed and arranged so as to fill the cavity of said heel section.

14. A shoe as claimed in claim 11, wherein said shoe includes a forepart former, said forepart former having a shape generally corresponding to the shape of the forepart portion of the shoe.

15. A shoe as claimed in claim 14, wherein said shoe further comprises a heel former defining a required shape and form for said heel section, said heel former being integrally formed with said forepart former.

16. A shoe as claimed in claim 11 wherein said shoe has a finish applied thereto, said finish being selected from the group consisting of leather, plastics material and a combination of leather and plastics material.

17. A shoe as claimed in claim 16, wherein said shoe further comprises a shoe sole secured to the underside of the open loop heel section and forepart section.

18. A shoe as claimed in claim 11, wherein said shoe is formed from a shoe blank formed from a material selected from the group consisting of a plastics material, leather, rubber, Kevlar, nylon, and a combination of a plastics material, leather, rubber, Kevlar and nylon.

19. A shoe as claimed in claim 18, wherein said plastics material is selected from the group consisting of fiber-reinforced plastics material, a polyurethane, a combination of polyurethanes, foam, and a combination of fiber-reinforced plastics material, a polyurethane, a combination of polyurethanes, foam.

20. A one-piece shoe blank for use in a method of forming a shoe as claimed in claim 1, said shoe blank having first and second opposed ends with a series of portions between the first and second ends, said series of portions comprising in order from the first end a forepart portion, a foot bed portion, a heel shaft portion, a heel sole portion, an upper portion and a securing portion.

* * * * *